United States Patent [19]

Tsujimura et al.

[11] Patent Number: 4,612,881

[45] Date of Patent: Sep. 23, 1986

[54] GAS VALVE DRIVING APPARATUS OF A GAS ENGINE

[75] Inventors: Iwao Tsujimura, Mino; Katunori Kubo, Toyonaka, both of Japan

[73] Assignee: Yanmar Diesel Engine Co., Ltd., Osaka, Japan

[21] Appl. No.: 391,446

[22] Filed: Jun. 23, 1982

[30] Foreign Application Priority Data

Jun. 24, 1981 [JP] Japan ..... 56-94337[U]
Jun. 24, 1981 [JP] Japan ..... 56-94338[U]

[51] Int. Cl.[4] ..... F02B 3/00

[52] U.S. Cl. ..... 123/27 GE; 123/527; 123/575

[58] Field of Search ..... 123/432, 27 GE, 527, 123/528, 529, 90.6, 575

[56] References Cited

U.S. PATENT DOCUMENTS 1,899,869 2/1933 Heusser ..... 123/27 GE
1,930,261 10/1933 Berry ..... 123/90.6
2,011,124 8/1935 Smith ..... 123/90.6
2,678,030 5/1954 Bader et al. ..... 123/27 GE
2,781,030 2/1957 Miller ..... 123/27 GE

FOREIGN PATENT DOCUMENTS 497398 11/1953 Canada ..... 123/27 GE

*Primary Examiner*—Craig R. Feinberg
*Assistant Examiner*—David A. Okonsky
*Attorney, Agent, or Firm*—Armstrong, Nikaido, Marmelstein & Kubovcik

[57] ABSTRACT

A gas valve driving apparatus of a gas engine in which a gas supply passage is connected to an intake means of the engine, comprises a gas valve arranged in the gas supply passage; a gas valve cam provided on a cam shaft in a cam chamber formed by a cylinder block of the engine and being independent of an intake cam and an exhaust cam on the cam shaft; and connecting means operable to connect the gas valve cam and the gas valve together, so that the gas valve cam may drive the gas valve through the connecting means. The connecting means may be provided with a rocker arm or may be provided with a tappet. The tappet and the gas valve are aligned on a same line extending toward the center of the cam shaft.

5 Claims, 5 Drawing Figures

GAS VALVE DRIVING APPARATUS OF A GAS ENGINE

BACKGROUND OF THE INVENTION

The present invention relates to a gas valve driving apparatus of a gas engine, in which any of gas alone, A-heavy-oil (heavy oil of high quality) alone and a combination of the gas and the A-heavy-oil is available as fuel.

Constructions shown in FIGS. 1 and 2 have been known as gas valve driving mechanisms. In FIG. 1, an intake rocker arm 42 engaged with an intake cam 41 is operable to open and close a gas valve 44 as well as an intake valve 43. In FIG. 2, one end of a rocker arm 53 is engaged with a push rod 51 driven by an intake cam 52. Other end of the rocker arm 53 is connected to a sub-rocker arm 55 which is operable to open and close a gas valve 57 as well as an intake valve 56.

However, according to the apparatuses in FIGS. 1 and 2, since the gas valves 44 and 57 are driven by the intake cams 41 and 52, it is impossible to set opening and closing periods of the gas valves 44 and 57 independently with respect to the intake timing, whereby, opening and closing performance of the gas valve is undesirably restricted.

Although, it is not illustrated, there has been still another construction, in which a cam for a gas valve drives an oil hydraulic pump, which drives the gas valve. However, this construction has such disadvantages that the pump, hoses and others occupy a large space and require an expensive manufacturing cost.

Accordingly, it is an object of the invention to provide an improved apparatus, overcoming the above-noted disadvantages, which has a light and simple construction. It is another object to provide an apparatus in which opening and closing periods of a gas valve and a gas feeding period can be set in suitable values for a gas engine.

Other and further objects, features and advantages of the invention will appear more fully from the following description of the preferred embodiments of the invention.

DETAILED DESCRIPTION OF THE PREFERRED EMBODIMENTS

Figure 1:
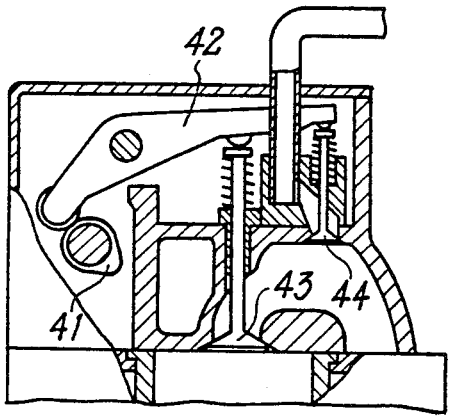
FIG. 1 PRIOR ART
FIG. 1 is a schematic sectional view of a known apparatus.
Figure 2:
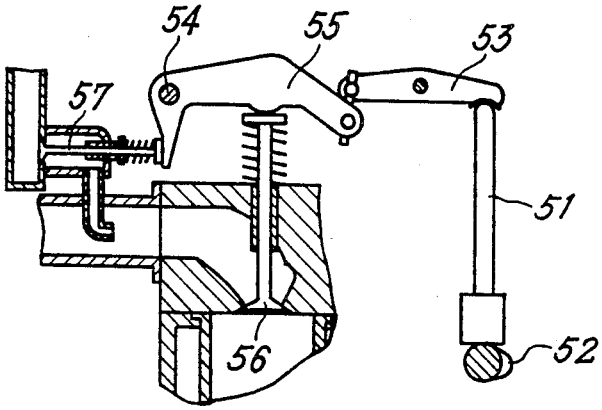
FIG. 2 PRIOR ART
FIG. 2 is a schematic sectional view of other known apparatus.
Figure 3:
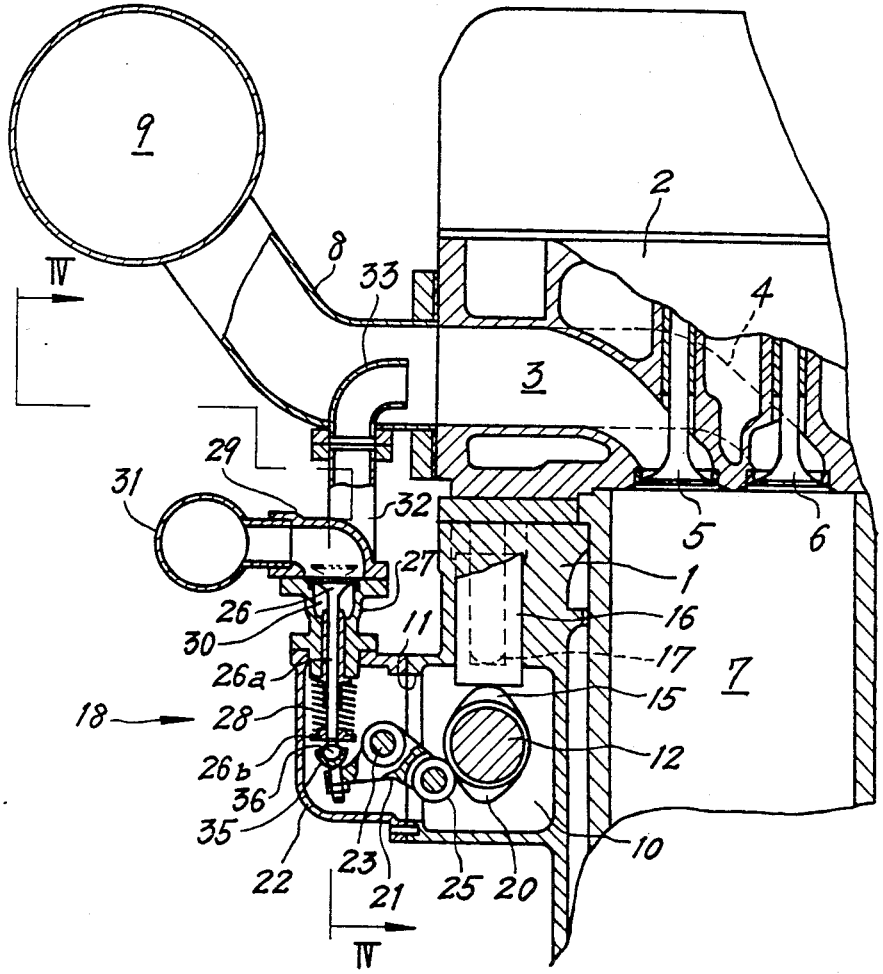
FIG. 3 is a sectional partial view of a gas engine employing a gas valve driving apparatus according to the invention.

Referring to FIG. 3, an intake passage 3 and an exhaust passage 4 are formed in a cylinder head 2 secured to a top surface of a cylinder block 1. Both passages 3 and 4 are opened to a top of a combustion chamber 7 with an intake valve 5 and an exhaust valve 6 therebetween, respectively. The inlet portion (left portion in FIG. 3) of the intake passage 3 is connected to an intake manifold 8 (intake means) which is connected to an air intake means 9 such as an air cleaner.

A cam chamber 10 is formed at a side portion of the cylinder block 1. An opening 11 is formed at an outside (left in FIG. 3) portion of the chamber 10. A cam shaft 12 is arranged in the cam chamber 10, and is rotatably supported by side walls of the chamber 10 which is parallel to the sheet of FIG. 3. The cam shaft 12 is connected to a crank shaft of an engine through gear mechanisms (not shown). The cam shaft 12 is provided with an intake cam 15 and an exhaust cam (not shown). The intake cam 15 is in contact with a bottom face of a cylindrical tappet 16 having a closed bottom and an open top. A lower end of a push rod 17 for the intake valve 5 is inserted into the tappet 16 and is in contact with the bottom of the tappet 16. The upper end (not shown) of the push rod 17 is connected to the intake cam 5 through a rocker arm.

Figure 4:
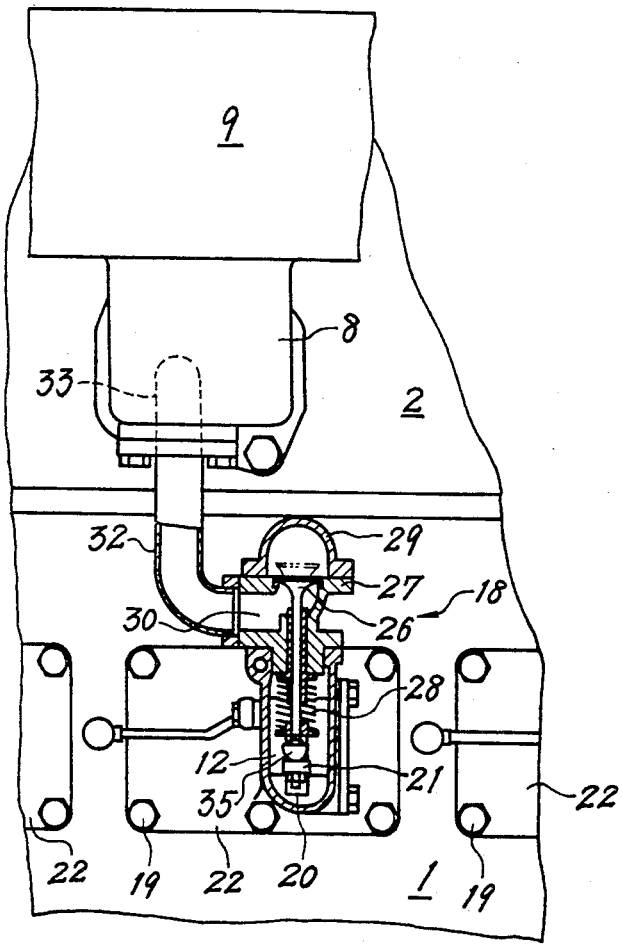
FIG. 4 is a sectional view taken along a line IV—IV in FIG. 3.

The cam shaft 12 is also provided with a cam 20 for a gas valve 26. The gas valve cam 20 is axially spaced to the intake cam 15 and the exhaust cam on the cam shaft 12. A gas valve driving mechanism 18 comprising a rocker arm 21, a driving case 22 and others is assembled as one unit and is fixed to an end portion of the wall of the chamber 10 around the opening 11. More concretely, the case 22 is fixed by bolts 19 (see FIG. 4) to the end portion of the wall of the chamber 10 around the opening 11, so that the case 22 may cover the opening 11. The case 22 can be removed from the chamber 10. The space in the case 22 is connected to the chamber 10. A middle portion of the rocker arm 21 is rotatably supported by a support shaft 23 which is fixed to the case 22. One end of the arm 21 is engaged with the cam 20 through a rotatable roller 25, and other end of the arm 21 is pivotably connected to a lower end of a rod **26*a* of the valve 26 through a ball joint constituted of a spherical bearing 35 and a ball 36. The spherical bearing 35 is screwed to the rocker arm 21, so that a free space from the valve 26 can be adjusted by changing a vertical position of the bearing 35 with respect to the arm 21. A valve case 27 is fixed to a top wall of the case 22 and is engaged into an opening formed in the top wall of the case 22. The gas valve 26 vertically extends in the case 27 and is slidably supported by the case 27. A compressed valve spring 28 is arranged between a spring seat 26*b* and the lower end face of the case 27 in the case 22. The spring seat 26*b* is fixed at the lower end of the rod 26*a*. The spring 28 elastically forces and seats the valve 26 at a valve seat formed at a top of the case 27. An end of a joint pipe 29 is fixed to the upper end of the case 27, and other end of the pipe 29 is connected to a main gas pipe 31, so that a gas passage 30 in the case 27 is connected to the pipe 31 through the gas valve 26 and the passage in the pipe 29. An outlet of the passage 30 in the case 27 is connected, as shown in FIG. 4, to a gas supply pipe 32, which is connected to a gas supply pipe 33. The pipe 33 is substantially L-shaped and is fixed to a lower wall of the intake manifold 8. The pipe 33 penetrates the lower wall of the manifold 8 and enters into the manifold 8. The outlet of the pipe 33 is opened toward the cylinder head 2**.

As shown in FIG. 4, the gas valve driving mechanism 18 assembled as one unit is fixed to each of the cylinders.

An operation of the mechanism 18 is as follows. While the roller 25 contacts with the basic circle of the cam 20, the gas valve 26 is closed. When the roller 26 starts to contact with the cam face of the cam 20, the rod 26*a* is lifted by the cam 20 through the rocker arm 21, and the valve 26 starts to open, so that the gas flowing from the main pipe 31 through the pipe 29 is supplied into the manifold 8 through the gas valve 26, the gas passage 30, the pipe 32 and the pipe 33.

In such case that the engine is driven by consuming the A-heavy-oil (heavy oil of high quality) alone as fuel, the whole of the gas valve driving mechanism 18 is removed as one unit from the manifold 8 and the side wall of the cam chamber 10 around the opening 11, and the opening 11 and the lower end of the pipe 33 are closed by covers or caps fixed thereto, respectively.

According to the invention, as stated hereinabove, the cam shaft 12 is provided with the gas valve cam 20 independent of the intake cam 15 and the exhaust cam. The cam 20 is operable to drive the gas valve 26 through connecting means such as the rocker arm 21 for the valve 26. Therefore, the shape of the cam 20 and the circumferential position of the cam 20 around the shaft 12 can be determined freely and independently with respect to other cams, whereby the most suitable periods in opening and closing operation of the gas valve and the most suitable period in gas supplying operation can be set with respect to the intake timing, thus, a maximum power of the engine can be easily increased. Of course, the apparatus according to the invention does not substantially increase manufacturing cost of the apparatus.

Since the apparatus according to the invention is provided with the connecting means such as the rocker arm 21 and the rod 26*a* for the gas valve 26 which are independent of the rocker arm for the intake valve 5 and the push rod 17 for the intake valve 5, any excessive load is not applied to the push rod 17 and the rocker arm for the intake valve 5 in the driving operation of the gas valve 26, whereby the best operation of the intake valve 5 and the gas valve 26 can always be achieved.

In the illustrated embodiment, the driving mechanism 18 is assembled as one unit and is removably fixed to the side wall of the cam chamber 10 around the opening 11, and the gas supply pipe 33 is fixed to the intake manifold 8.

In this construction, the assembled driving mechanism 18 can be fixed by easy operation, and further, the cylinder block 1 and the cylinder head 2 for a conventional diesel engine can be used for the gas engine according to the invention without conversion. Therefore, the gas engine can be manufactured rationally and economically.

Further in the illustrated construction, the gas valve 26 is designed to move in the same direction as that of the flow of the gas, when the valve 26 is closed. Therefore, the gas pressure in the pipe 29 forces the closed valve 26 against the valve seat, so that the gas valve 26 can surely be closed, and the gas does not leak into the passage 30 through the closed valve 26. Thus, the opening and closing operations of the gas valve 26 can reliably be achieved.

Figure 5:
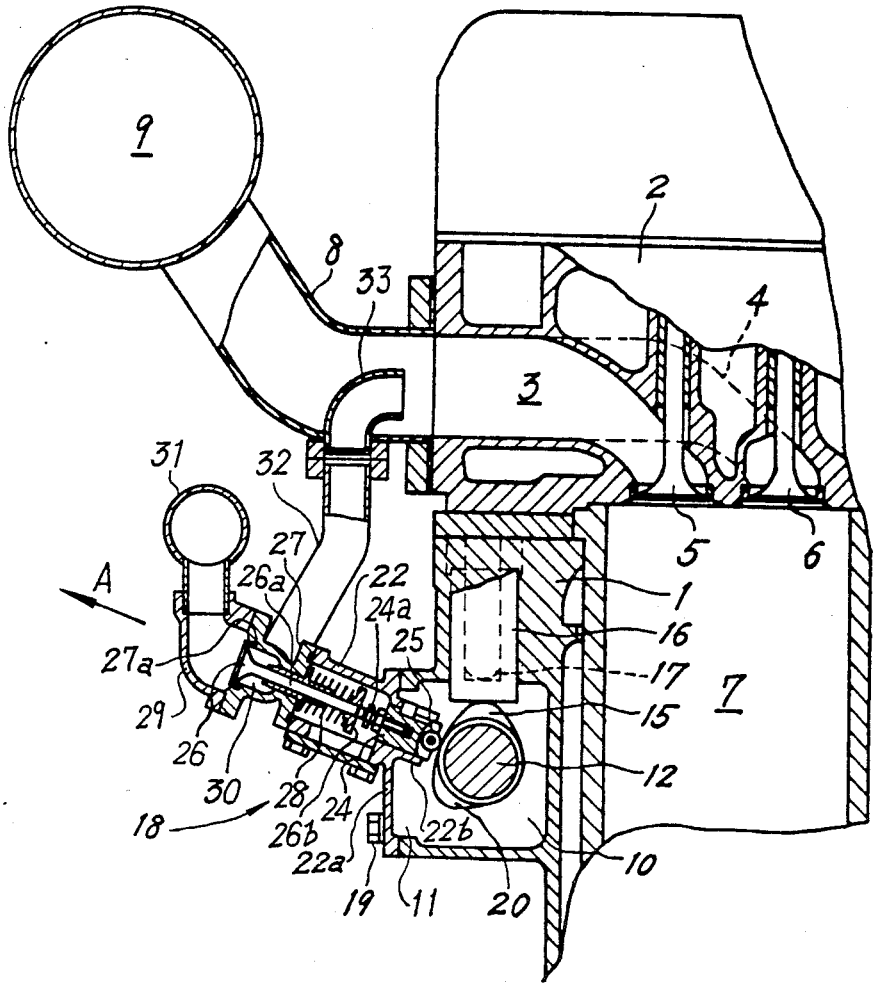
FIG. 5 is a sectional partial view of an apparatus of other embodiment.

The present invention may be modified as shown in FIG. 5, in which same or similar members and portions bear same or similar numerals as those in FIG. 3. Referring to FIG. 5, a cam shaft 12 is provided with a gas valve cam 20 which is axially spaced to an intake cam 15 and an exhaust cam (not shown). A gas valve driving mechanism 18 comprising a gas valve tapet 24, a driving case 22 and others is assembled as one unit and is fixed to an end portion of a wall of a cam chamber 10 around an opening 11.

The case 22 is provided with an integral cover 22*a* for the cam chamber 10, which is fixed by bolts 19 to the end portion of the chamber 10 around the opening 11. The case 22 is inclined so that an end 22*b* adjacent to the cam shaft 12 occupies a lower position than other end. The end 22*b* is in the chamber 10 and protrudes toward the center of the cam shaft 12. The tappet 24 is fitted into the end 22*b* and is slidable in a direction shown by an arrow A from the illustrated position. An end of the tappet 24 rotatably supports a rotatable roller 25, which contacts with the gas valve cam 20. Other end of the tappet 24 has a screw hole into which a bolt 24*a* for adjusting a lift distance is screwed. A head of the adjuster bolt 24*a* is engaged with an end of a gas valve rod 26*a*. The rod 26*a* of the gas valve 26 is fitted into a cylindrical valve case 27 and is slidable in the direction shown by the arrow A from the illustrated position in which the roller 25 contacts with the basic circle of the cam 20. The case 27 is fixed to the end face of the case 22 opposite to the cam 20 and is provided with an internal gas passage 30. A compressed valve spring 28 is arranged between the valve case 27 and a spring seat 26*b* which is fixed at the end of the valve rod 26*a*. In the illustrated position, the valve 26 is seated at a valve seat 27*a* in the case 27 by the elastic force of the spring 28. An end of the case 27 opposite to the cam 20 is connected to a main gas pipe 31 through an inlet joint pipe 29. An outlet (not shown) of the case 27 is connected to one end of a gas supply pipe 32, of which other end is connected to a substantially L-shaped gas supply pipe 33 fixed to a lower wall of a intake manifold 8. The pipe 33 penetrates the lower wall of the manifold 8 and is opened at its outlet toward the cylinder head 2.

Also in this embodiment, the gas valve 26 is driven by the cam 20. In such case that the engine is driven by consuming the A-heavy-oil (heavy oil of high quarity) alone as the fuel, the whole of the gas valve driving mechanism 18 in FIG. 5 is removed as one unit from the manifold 8 and the side wall of the cam chamber 10 around the opening 11, an the opening 11 and the lower end of the pipe 33 are closed by covers or caps.

According to the apparatus in FIG. 5, same effects as those by the apparatus in FIG. 3 can be obtained, and in addition, following effect can also be obtained.

Since such linear or direct drive system is employed that the gas valve rod 26*a* and the tappet 24 are aligned on a same line extending toward the center of the cam shaft 12, high rigidity is obtained in the gas valve 26, tappet 24 and other driving members, which is desirable for the high speed engine. And more concretely, for example, the high rigidity prevents undesirable vibration of the gas valve 26.

Although, the apparatus in FIG. 5 is provided with the rotatable roller 25 which contacts with the cam 20, such construction may be employed that the roller 25 is eliminated, and that the tappet 24 directly contacts with the gas valve cam 20.

Although the invention has been described in its preferred form with a certain degree of particularity, it is understood that the present disclosure of the preferred form may be changed in the details of construction and the combination, and arrangement of parts may be resorted to without departing from the spirit and scope of the invention as hereinafter claimed.

What is claimed:

1. A gas valve driving apparatus of a gas engine in which a gas supply passage is connected to an intake means of the engine, comprising a gas valve arranged in the gas supply passage; a gas valve cam provided on a cam shaft in a cam chamber formed by a cylinder block of the engine and being independent of an intake cam and an exhaust cam on the cam shaft; and connecting means for connecting the gas valve cam and the gas valve together, so that the gas valve cam drives the gas valve through the connecting means, said gas valve and said connecting means being contained in a single unit which is fixed to a wall of the cam chamber and is removable therefrom separate from intake and exhaust valves of the engine.

2. An apparatus of claim 1 wherein the connecting means is provided with a rocker arm for the gas valve.

3. An apparatus of claim 1 wherein the connecting means is provided with a tappet, and the tappet and the gas valve are aligned on a same line extending toward the center of the cam shaft.

4. An apparatus of any one of claims 1 to 3 wherein said single unit includes a case covering said connecting means.

5. An apparatus of any one of claims 1 to 3 wherein said gas valve is designed to close by a movement in a same direction as that of the gas flow in the gas supply passage.

* * * * *